US010566691B2

(12) United States Patent
Choi et al.

(10) Patent No.: US 10,566,691 B2
(45) Date of Patent: Feb. 18, 2020

(54) RECEPTACLE CONNECTOR HAVING ANTENNA FUNCTION

(71) Applicant: SRB CO., LTD., Seongnam-si, Gyeonggi-do (KR)

(72) Inventors: Jae Hyuk Choi, Seoul (KR); Hoon Ahn, Anyang-si (KR); Seong Kyu Lim, Seoul (KR); Woo Jeong Kang, Yongin-si (KR)

(73) Assignee: SRB CO., LTD., Seongnam-si (KR)

( * ) Notice: Subject to any disclaimer, the term of this patent is extended or adjusted under 35 U.S.C. 154(b) by 72 days.

(21) Appl. No.: 15/579,575

(22) PCT Filed: Jun. 29, 2016

(86) PCT No.: PCT/KR2016/006972
§ 371 (c)(1),
(2) Date: Dec. 4, 2017

(87) PCT Pub. No.: WO2017/003184
PCT Pub. Date: Jan. 5, 2017

(65) Prior Publication Data

US 2018/0175497 A1 Jun. 21, 2018

(30) Foreign Application Priority Data

Jun. 29, 2015 (KR) ..... 10-2015-0092425

(51) Int. Cl.
*H01R 13/648* (2006.01)
*H01Q 1/52* (2006.01)
(Continued)

(52) U.S. Cl.
CPC ..... *H01Q 1/526* (2013.01); *H01Q 1/22* (2013.01); *H01Q 1/24* (2013.01); *H01Q 1/38* (2013.01);
(Continued)

(58) Field of Classification Search
CPC ..... H01R 13/65802; H01R 13/658; H01R 23/6873; H01R 23/688
(Continued)

(56) References Cited

U.S. PATENT DOCUMENTS 5,637,014 A * 6/1997 Sukegawa ..... H01R 23/6873 439/607.4
9,077,096 B2 * 7/2015 Simmel ..... H01R 13/502
(Continued)

FOREIGN PATENT DOCUMENTS

CN 102790322 A 11/2012
CN 103811844 A 5/2014
(Continued)

*Primary Examiner* — Phuong Chi Thi Nguyen
(74) *Attorney, Agent, or Firm* — Maschoff Brennan

(57) ABSTRACT

Disclosed is a receptacle connector that can be freely positioned and that has excellent space utilization. A receptacle connector having an antenna function according to an aspect of the present invention is a receptacle connector for electrically connecting a plug connector and a circuit board and comprises a metal housing, a contact assembly, and a ceramic shell. The metal housing has an open front surface and an interior formed in a hollow shape. The contact assembly is provided with a plurality of contacts installed inside the metal housing to relay electrical signals. The ceramic shell is coupled in a shape surrounding the housing. The top surface of the ceramic shell has an antenna pattern formed thereon.

3 Claims, 3 Drawing Sheets

(51) Int. Cl.

| | |
|---|---|
| ***H01R 13/6581*** | (2011.01) |
| ***H01Q 1/22*** | (2006.01) |
| ***H01Q 1/44*** | (2006.01) |
| ***H01R 12/72*** | (2011.01) |
| ***H01R 12/71*** | (2011.01) |
| ***H01Q 1/24*** | (2006.01) |
| ***H01Q 1/38*** | (2006.01) |
| ***H01R 13/6598*** | (2011.01) |
| *H01Q 9/42* | (2006.01) |

(52) U.S. Cl.
CPC ..... *H01Q 1/44* (2013.01); *H01R 12/71* (2013.01); *H01R 12/724* (2013.01); *H01R 13/6581* (2013.01); *H01R 13/6598* (2013.01); *H01Q 9/42* (2013.01); *H01R 2201/02* (2013.01)

(58) Field of Classification Search
USPC ..... 439/607.01–607.59, 95, 108
See application file for complete search history.

(56) References Cited

U.S. PATENT DOCUMENTS

| | | | | |
|---|---|---|---|---|
| 2011/0076891 | A1 | 3/2011 | Kim et al. | |
| 2014/0073182 | A1 | 3/2014 | Ardisana, II et al. | |
| 2016/0181746 | A1* | 6/2016 | Simmel ..... | H01R 13/502<br>439/607.01 |
| 2017/0077654 | A1* | 3/2017 | Yao ..... | H01R 13/6594 |

FOREIGN PATENT DOCUMENTS

| | | | |
|---|---|---|---|
| CN | 104112933 | A | 10/2014 |
| CN | 204333335 | U | 5/2015 |
| KR | 10 0163767 | B1 | 12/1990 |
| KR | 10 2013 0122741 | A | 11/2013 |

* cited by examiner

RECEPTACLE CONNECTOR HAVING ANTENNA FUNCTION

TECHNICAL FIELD

The present invention relates to a receptacle connector, and more particularly, to a receptacle connector mounted on a printed circuit board (PCB) inside electronic devices such as portable terminals, and the like.

BACKGROUND ART

Connectors are components widely applied to electronic devices such as portable terminals, and the like. Recently, as electronic devices become smaller, connectors have gradually become smaller and thinner. In addition, the higher the density of electronic elements mounted on a circuit board, the greater the number of contacts included in a connector device and the narrower the arrangement pitch between contacts.

Generally, a connector consists of a receptacle connector in which a plurality of receptacle contacts is installed in a receptacle insulator, and a plug connector in which a plurality of plug contacts, contacting the receptacle contacts in a one-to-one manner, is installed in a plug insulator.

The receptacle contacts and the plug contacts are connected to a receptacle-side cable and a plug-side cable, respectively, or are mounted on a circuit board. When a plug is inserted into a receptacle so that the receptacle contacts are brought into contact with the plug contacts, the receptacle-side cable and the plug-side cable or circuits of the circuit boards are electrically connected to each other. Thus, the connector performs data communication with an external device or power is supplied thereto.

FIGS. 1 and 2 illustrate an example of a conventional receptacle connector. The receptacle connector illustrated in FIGS. 1 and 2 includes a contact assembly 10 fabricated such that contacts 11 are formed in an insulator 12 by insertion molding, and a shell 20 covering the insulator 12 and made of a metal material. In the receptacle connector, the contacts 11 are insulated from each other by the insulator 12, are arranged at a constant pitch, and are protected and shielded by the shell 20 covering the insulator 12. In particular, the shell 20 is a main component that considerably affects electrical reliability of the receptacle connector as well as bonding strength thereof for a substrate and matching thereof with the corresponding plug connector.

However, the shell of the conventional receptacle connector is made of a metal material, and thus, when an antenna is installed around the receptacle connector, the antenna cannot properly function. In addition, when an antenna is positioned apart from the receptacle connector to secure antenna performance, the degree of freedom of product design is decreased.

DISCLOSURE

Technical Problem

Therefore, the present invention has been made in view of the above problems, and it is one object of the present invention to provide a receptacle connector that is freely positioned and exhibits excellent space utilization.

Technical Solution

A receptacle connector having an antenna function according to an embodiment of the present invention is a receptacle connector that electrically connects a plug connector and a circuit substrate, and includes a metal housing, a contact assembly, and a ceramic shell. The metal housing has an opening at a front surface thereof and a hollow shape. The contact assembly is installed in the metal housing and includes a plurality of contacts to transmit an electrical signal. The ceramic shell is coupled to the metal housing in a form covering the metal housing. The ceramic shell is provided with an antenna pattern at an upper surface thereof.

In another embodiment of the present invention, the plurality of contacts may be formed on a ceramic substrate.

In another embodiment of the present invention, the antenna pattern may have a form recessed from a surface of the ceramic shell.

In another embodiment of the present invention, the contact assembly may further include an electromagnetic compatibility (EMC) cover that electrically connects the metal housing and some of the plurality of contacts to remove electrical noise generated from the contacts.

Advantageous Effects

According to the present invention, a separate space for an antenna is not needed, and thus an overall size of a product can be reduced. In addition, an antenna is arranged on an upper surface of a ceramic shell covering a metal housing, and thus performance deterioration of the antenna due to a metal of the metal housing can be prevented.

BEST MODE

Figure 1:
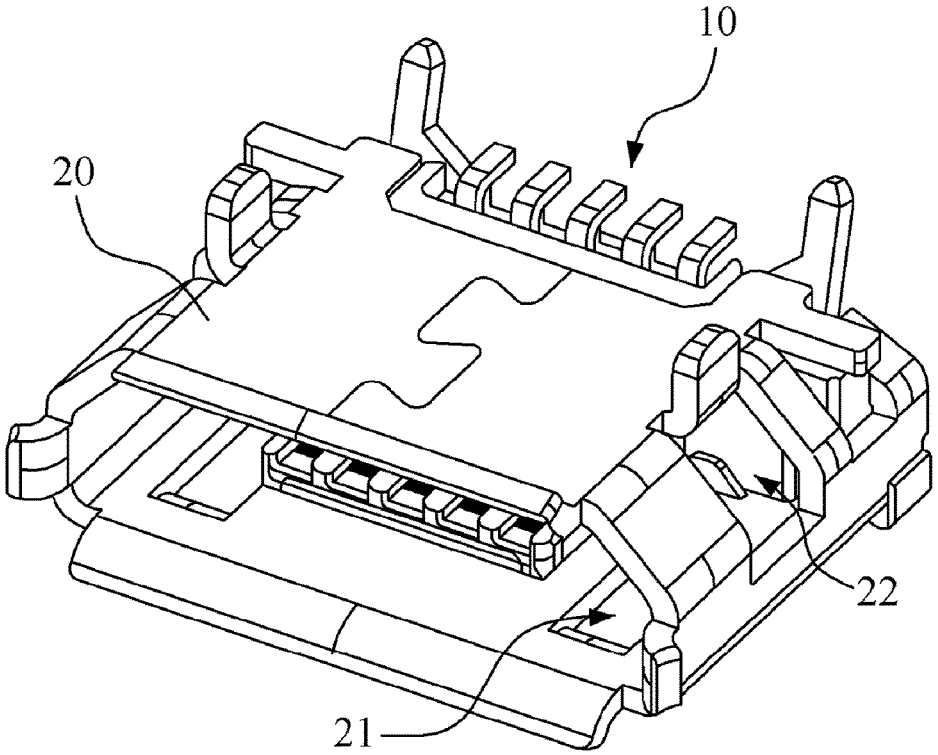
FIG. 1 is a perspective view of a conventional receptacle connector.
Figure 2:
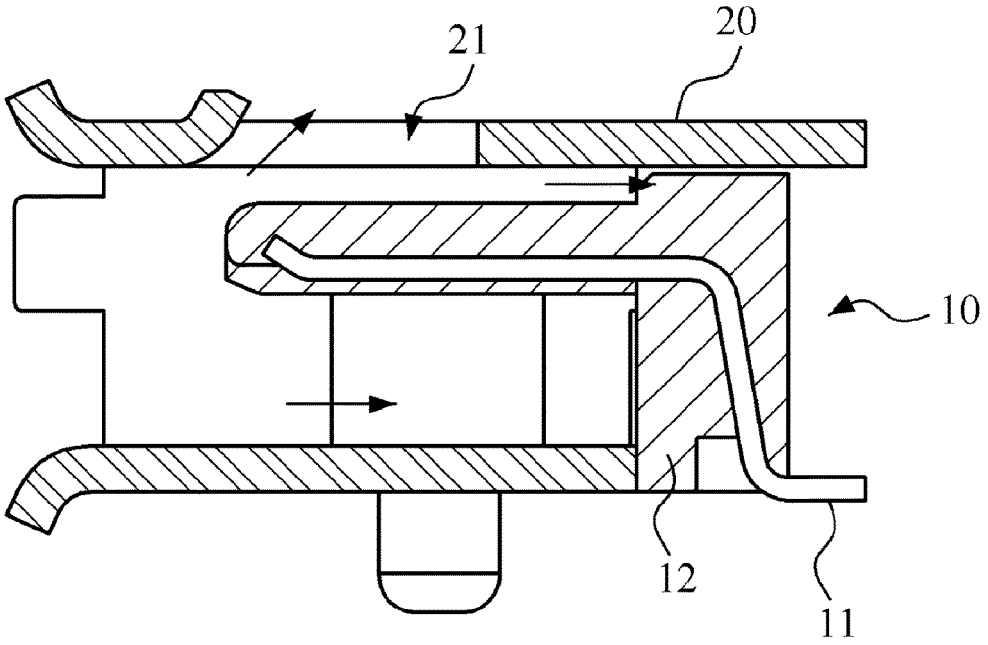
FIG. 2 is a cross-sectional view of FIG. 1.

The above and other aspects will become apparent from embodiments described below. In the present specification, like reference numerals denote like elements in the drawings. In addition, the shapes or sizes of elements may be exaggerated. In addition, detailed explanations of related art are omitted when it is deemed that they may unnecessarily obscure the essence of the invention.

Hereinafter, the present invention will be described in detail with reference to the accompanying drawings.

Figure 3:
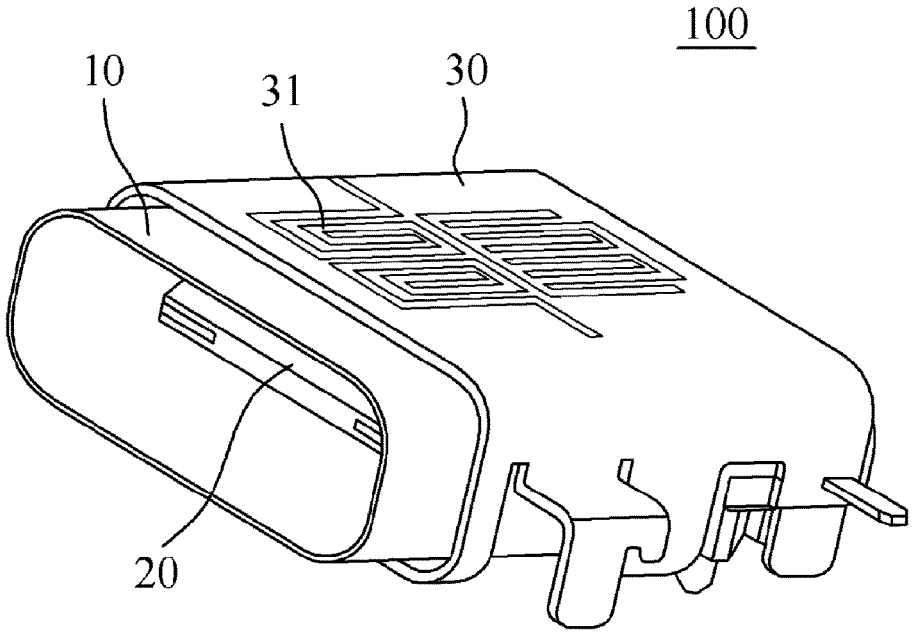
FIG. 3 is a perspective view of a receptacle connector according to an embodiment of the present invention.
Figure 4:
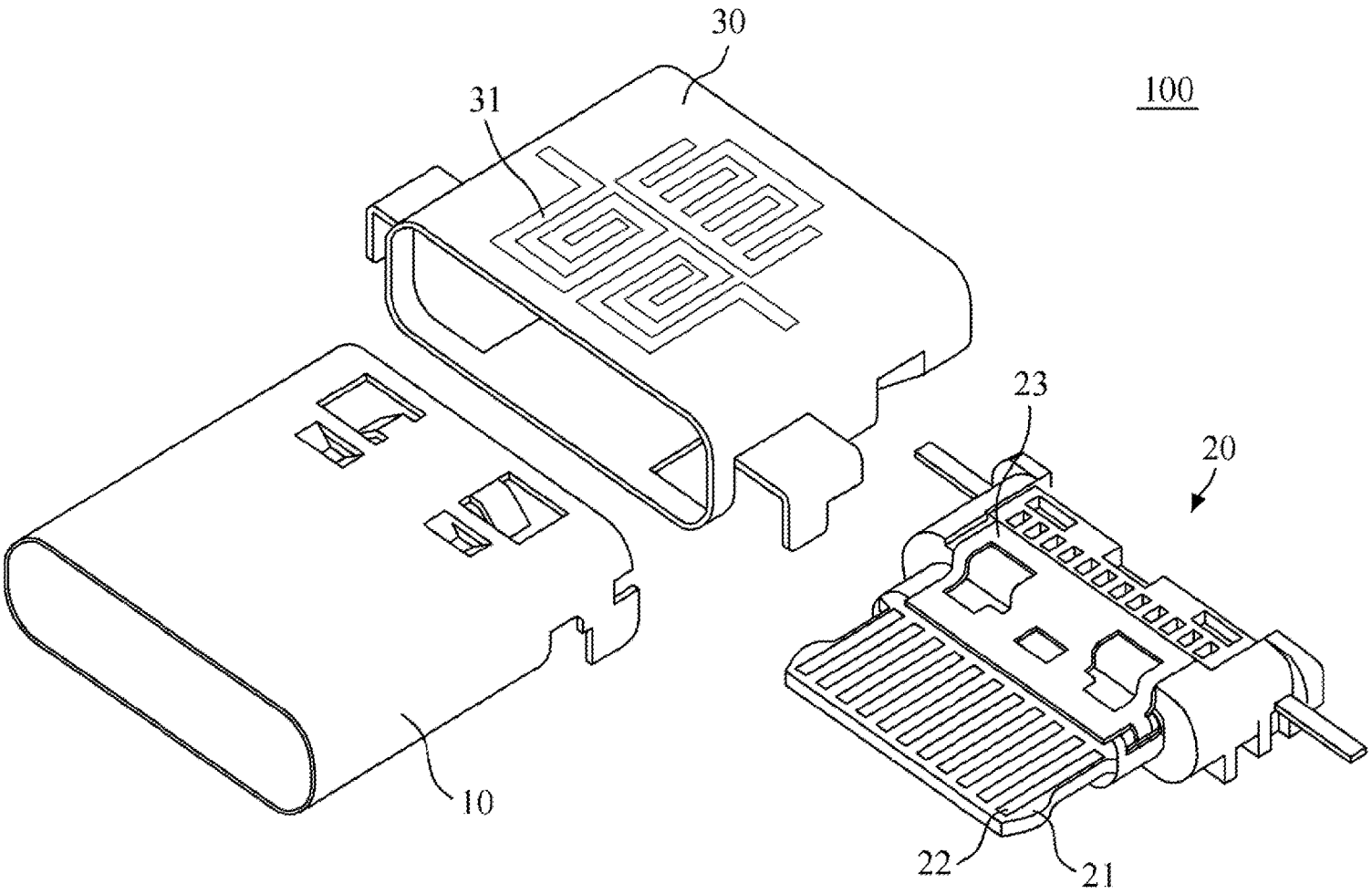
FIG. 4 is an exploded perspective view of the receptacle connector of FIG. 3.

FIG. 3 is a perspective view of a receptacle connector 100 according to an embodiment of the present invention. FIG. 4 is an exploded perspective view of the receptacle connector 100 of FIG. 3.

Referring to FIGS. 3 and 4, the receptacle connector 100, which is a device mounted on a printed circuit board in an electronic device and electrically connecting a plug connector and a circuit board, includes a metal housing 10, a contact assembly 20, and a ceramic shell 30.

The metal housing 10 has an opening at a front surface thereof and a hollow shape. The metal housing 10 may have a rectangular parallelepiped shape with curved side surfaces. The metal housing 10 may be fabricated by pressing a metal plate. The metal housing 10 has a hollow shape, and thus an applicable plug connector may be inserted thereinto.

The contact assembly 20 is installed in the metal housing 10 and includes a plurality of contacts 22 to transmit an electrical signal. Contacts of the receptacle connector 100 are brought into contact with contacts of a plug connector so that an electrical signal is transmitted between the receptacle connector 100 and the plug connector. The contact assembly 20 may include contacts 22 and a receptacle insulator 21 disposed between the contacts 22 to insulate the contacts 22 from each other. The contact assembly 20 may be fabricated by inserting the contacts 22 into a mold and then obtaining the receptacle insulator 21 by injection molding.

The ceramic shell 30 is coupled to the metal housing 10 in a form covering the metal housing 10. The ceramic shell 30 has an opening at a front surface thereof and a hollow shape. The ceramic shell 30 may have a rectangular parallelepiped shape with curved side surfaces. The ceramic shell 30 may be colored. To impart color to the ceramic shell 30, a pigment is added to ceramic powder. A product manufactured by including the colored ceramic shell 30 may have improved aesthetics.

Antenna patterns 31 are arranged on an upper surface of the ceramic shell 30. A separate member such as a flexible printed circuit board (FPCB) with antenna patterns may be attached to the upper surface of the ceramic shell 30, or antenna patterns may be formed on a surface of a ceramic shell. To form the antenna patterns 31, the surface of the ceramic shell may be printed with a conductive ink. The conductive ink may be formed of silver particles.

When the receptacle connector 100 having the above-described antenna function is used, a separate space for an antenna is not needed, and thus an overall size of a product may be reduced. In addition, an antenna is arranged on the upper surface of the ceramic shell 30 covering the metal housing 10, and thus performance deterioration of the antenna due to a metal of the metal housing 10 may be prevented.

In addition, the plurality of contacts 22 may be formed on a ceramic substrate. The ceramic substrate may be made using low temperature co-fired ceramic (LTCC) calcined at 1,000° C. or less or high temperature co-fired ceramic (HTCC) calcined at 1,500° C. or more. The ceramic substrate may have a tetragonal shape. The plurality of contacts 22 may be formed on the ceramic substrate using a deposition technique, or by printing.

In addition, the antenna patterns 31 may have a form recessed from the surface of the ceramic shell 30. To make the antenna patterns 31 having a form recessed from the surface of the ceramic shell 30, the surface of the ceramic shell 30 may be processed to form a space for antenna patterns and then the space may be filled with a conductive ink. When the antenna patterns 31 have a form recessed from the surface of the ceramic shell 30, less damage to the antenna patterns 31 due to friction or collision with another member may occur.

The antenna patterns 31 may have a form protruding from the surface of the ceramic shell 30. To make the antenna patterns 31 having a form protruding from the surface of the ceramic shell 30, the surface of the ceramic shell 30 may be printed with a conductive ink. The process of forming antenna patterns on the surface of the ceramic shell 30 by printing using a conductive ink is simple, and thus productivity is improved.

In addition, the contact assembly 20 may further include an electromagnetic compatibility (EMC) cover 23 that electrically connects the metal housing 10 and some of the contacts 22 to remove electrical noise generated from the contacts 22. The EMC cover 23 may have a first contact portion and a second contact portion that contact the metal housing 10 and some of the contacts 22, respectively, and a connection portion connecting the first and second contact portions to each other. The connection portion may be bent.

While embodiments of the present invention have been described with reference to the accompanying drawings, these are provided for illustrative purposes only. In addition, it will be understood by one of ordinary skill in the art that various changes and other equivalent embodiments can be made. Thus, the true spirit and scope of the present invention should be defined by the following claims.

The invention claimed is:

1. A receptacle connector having an antenna function, electrically connecting a plug connector and a circuit board, the receptacle connector comprising:

a metal housing having an opening at a front surface thereof and a hollow shape;

a contact assembly installed in the metal housing and comprising a plurality of contacts to transmit an electrical signal; and a ceramic shell coupled to the metal housing in a form covering the metal housing, wherein the ceramic shell is provided with an antenna pattern at an upper surface thereof;

wherein the contact assembly further comprises an electromagnetic compatibility (EMC) cover that electrically connects the metal housing and some of the plurality of contacts to remove electrical noise generated from the contacts.

2. The receptacle connector according to claim 1, wherein the plurality of contacts are formed on a ceramic substrate.

3. The receptacle connector according to claim 1, wherein the antenna pattern has a form recessed from a surface of the ceramic shell.

* * * * *